US012604984B2

(12) United States Patent
Kumazawa

(10) Patent No.: US 12,604,984 B2
(45) Date of Patent: Apr. 21, 2026

(54) CHAIR

(71) Applicant: AICHI CO., LTD., Nagoya (JP)

(72) Inventor: Taku Kumazawa, Nagoya (JP)

(73) Assignee: AICHI CO., LTD., Nagoya (JP)

( * ) Notice: Subject to any disclaimer, the term of this patent is extended or adjusted under 35 U.S.C. 154(b) by 209 days.

(21) Appl. No.: 18/264,655

(22) PCT Filed: Feb. 7, 2022

(86) PCT No.: PCT/JP2022/004706

§ 371 (c)(1),
(2) Date: Aug. 8, 2023

(87) PCT Pub. No.: WO2022/172894

PCT Pub. Date: Aug. 18, 2022

(65) Prior Publication Data

US 2024/0298804 A1 Sep. 12, 2024

(30) Foreign Application Priority Data

Feb. 12, 2021 (JP) ..... 2021-020934

(51) Int. Cl.
*A47C 3/04* (2006.01)
*A47C 7/40* (2006.01)

(52) U.S. Cl.
CPC . *A47C 7/40* (2013.01); *A47C 3/04* (2013.01)

(58) Field of Classification Search
CPC ..... A47C 3/04; A47C 7/40
USPC ..... 297/448.2, 183.7
See application file for complete search history.

(56) References Cited

U.S. PATENT DOCUMENTS 3,273,922 A * 9/1966 Rasor ..... A47C 3/04 297/450.1
3,815,955 A * 6/1974 Gibilterra ..... A47C 3/023 297/448.2 X (Continued)

FOREIGN PATENT DOCUMENTS

JP S56115957 U 9/1981
JP S5921259 U 2/1984

(Continued)

OTHER PUBLICATIONS

International Search Report and Written Opinion for International Patent Application No. PCT/JP2022/004706, mailed Apr. 5, 2022, 12 pages.

(Continued)

*Primary Examiner* — Rodney B White
(74) *Attorney, Agent, or Firm* — Withrow + Terranova, PLLC; Vincent K. Gustafson

(57) ABSTRACT

A chair includes a backrest and a backrest frame. The backrest is configured to support a back of a user of the chair. The backrest frame supports the backrest. The backrest frame includes a right bar-shaped member, a left bar-shaped member, and an upper bar-shaped member. The right bar-shaped member supports a right side of the backrest. The left bar-shaped member supports a left side of the backrest. The upper bar-shaped member supports an upper side of the backrest. Further, the upper bar-shaped member protrudes so as to be convex toward a rear side, and connects the right bar-shaped member and the left bar-shaped member.

5 Claims, 9 Drawing Sheets

(56) References Cited

U.S. PATENT DOCUMENTS

| | | | | | |
|---|---|---|---|---|---|
| 3,999,802 | A * | 12/1976 | Powers | A47C 3/04 | 297/448.2 X |
| 4,522,444 | A | 6/1985 | Pollock | | |
| 5,383,712 | A * | 1/1995 | Perry | A47C 7/44 | 297/448.2 X |
| 5,823,626 | A * | 10/1998 | Haas | A47C 1/03277 | 297/448.2 X |
| RE36,335 | E * | 10/1999 | Perry | A47C 7/44 | 297/448.2 X |
| 5,997,094 | A * | 12/1999 | Cvek | A47C 3/12 | 297/448.2 X |
| 6,003,942 | A * | 12/1999 | Haas | A47C 1/03255 | 297/300.5 |
| 7,998,551 | B2 * | 8/2011 | Gasser | A47C 5/12 | 297/183.7 X |
| 2005/0104421 | A1 | 5/2005 | Astle et al. | | |

FOREIGN PATENT DOCUMENTS

| | | | | |
|---|---|---|---|---|
| JP | H09220136 | A | 8/1997 | |
| JP | 2006136570 | A | 6/2006 | |
| JP | 2011092539 | A | 5/2011 | |
| JP | 2012010933 | A | 1/2012 | |
| JP | 2012024617 | A | 2/2012 | |
| JP | 2012085904 | A | 5/2012 | |
| JP | 2015084927 | A | 5/2015 | |
| JP | 2016202838 | A | 12/2016 | |
| JP | 2021122371 | A | 8/2021 | |
| WO | WO-2021090338 | A1 * | 5/2021 | A47C 3/04 |

OTHER PUBLICATIONS

Examination Report for Australian Patent Application No. 2022218754, mailed Aug. 16, 2024, 3 pages.

Extended European Search Report for European Patent Application No. 22752718.1, mailed Dec. 5, 2024, 6 pages.

Notice of Reasons for Refusal for Japanese Patent Application No. 2021-020934, mailed Nov. 26, 2024, 14 pages.

Notice of Reasons for Refusal for Japanese Patent Application No. 2021-178917, mailed Nov. 26, 2024, 8 pages.

Notice of Reasons for Refusal for Japanese Patent Application No. 2021-178917 mailed Jun. 24, 2025, 13 pages.

* cited by examiner

CHAIR

CROSS-REFERENCE TO RELATED APPLICATION

This application is a 35 U.S.C. § 371 national phase filing of International Application No. PCT/JP2022/004706 filed on Feb. 7, 2022, and claims the benefit of Japanese Patent Application No. 2021-020934 filed on Feb. 12, 2021, wherein the entire contents of the foregoing applications are hereby incorporated by reference herein.

TECHNICAL FIELD

The present disclosure relates to a chair.

BACKGROUND ART

Patent Document 1 discloses a backrest of a chair. The backrest is configured by a front-covering, a backrest frame, and a rear support. In this backrest, the rear support is fixed to a rear side of a backrest frame by using a screw. Further, the front-covering is fixed to a front side of the backrest frame in such a manner that an engagement strip provided on the front-covering is latched onto a bridging bar provided on the backrest frame and also is engaged with the rear support by using a rivet.

PRIOR ART DOCUMENTS

Patent Documents

Patent Document 1: Japanese Unexamined Patent Application Publication No. H9-220136

SUMMARY OF THE INVENTION

Problems to be Solved by the Invention

Transportable chairs used in places such as a multipurpose hall are required to be configured to be easily carried.

In one aspect of the present disclosure, it is desirable to provide a chair including a portion that functions as a handhold for carrying.

Means for Solving the Problems

One embodiment of the present disclosure provides a chair comprising a backrest and a backrest frame. The backrest is configured to support a back of a user of the chair. The backrest frame supports the backrest. The backrest frame comprises a right bar-shaped member, a left bar-shaped member, and an upper bar-shaped member. The right bar-shaped member supports a right side of the backrest. The left bar-shaped member supports a left side of the backrest. The upper bar-shaped member supports an upper side of the backrest. Further, the upper bar-shaped member protrudes so as to be convex toward a rear side, and connects the right bar-shaped member and the left bar-shaped member.

With such a configuration, it is possible to provide a chair comprising a portion that functions as a handhold for carrying. That is, the upper bar-shaped member protrudes toward the rear side, so that it is possible to hold the upper bar-shaped member to carry the chair. This allows the upper bar-shaped member to function as a handhold for carrying the chair.

In one embodiment of the present disclosure, the backrest may comprise a main body and a bent portion. The main body is plate-like and abuts the back of the user. The bent portion is bent from an upper end portion of the main body and extends rearward. With such a configuration, the bent portion is shaped to extend rearward, so that it is possible to hold the bent portion to carry the chair. That is, the bent portion of the backrest can function as a handhold for carrying the chair. Further, longer a length of the bent portion is, larger an area of a portion functioning as a handhold is. This makes it easy to hold the bent portion, and as the result it becomes easy to carry the chair.

In one embodiment of the present disclosure, the backrest may be supported by the backrest frame such that a rear edge portion of the bent portion and the upper bar-shaped member abut on each other. With such a configuration, it is possible to hold at least one of the bent portion or the upper bar-shaped member to carry the chair. That is, it is possible for any of the bent portion and the upper bar-shaped member to function as a handhold. Accordingly, the area of the portion functioning as a handhold becomes larger, thus making it easy to hold the bent portion or the upper bar-shaped member. As the result, it becomes easy to carry the chair.

In one embodiment of the present disclosure, the backrest may be supported by the backrest frame so as to include a gap between the rear edge portion of the bent portion and the upper bar-shaped member. With such a configuration, it is possible to put a hand in a gap between the bent portion and the upper bar-shaped member to carry the chair. That is, the gap can function as a handhold hole.

EXPLANATION OF REFERENCE NUMERALS

Figure 1:
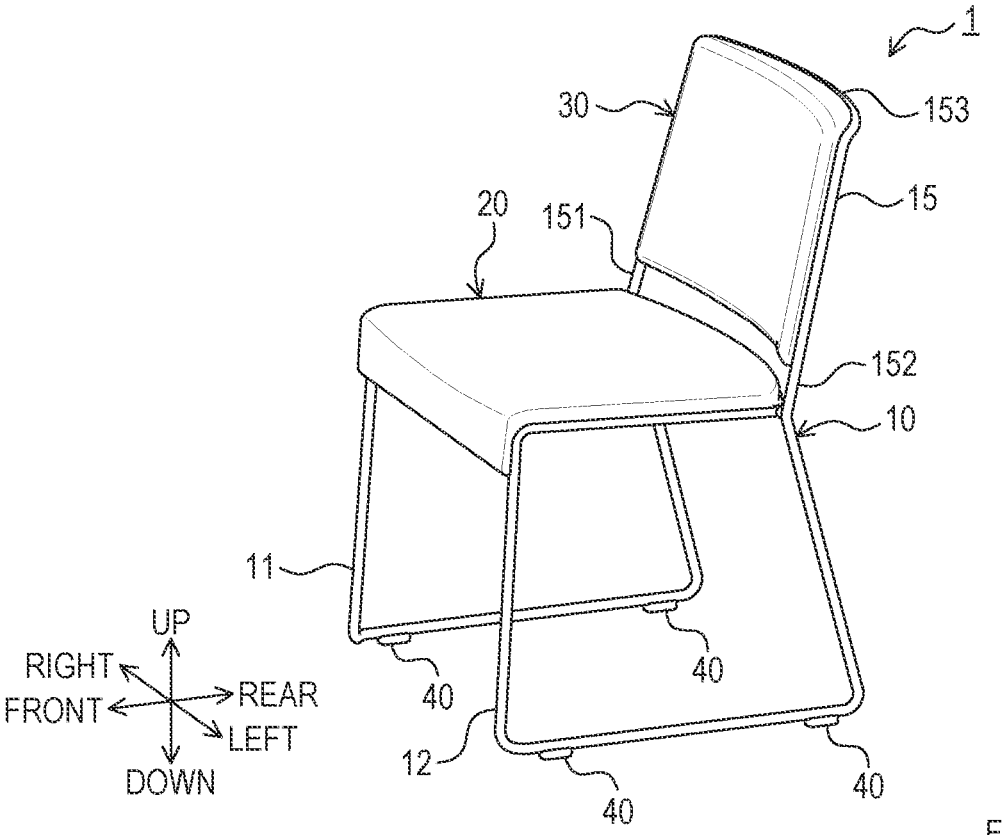
FIG. 1 is a perspective view of a chair when viewed from a front side.
Figure 2:
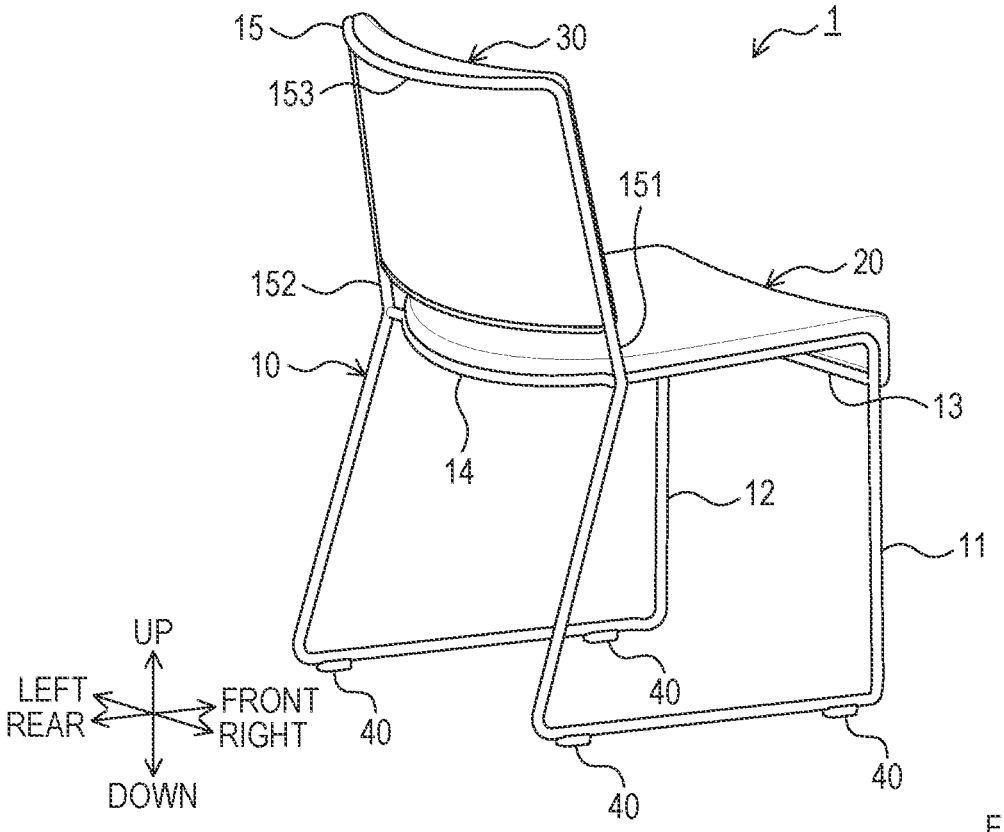
FIG. 2 a perspective view of the chair when viewed from a rear side.
Figure 3:
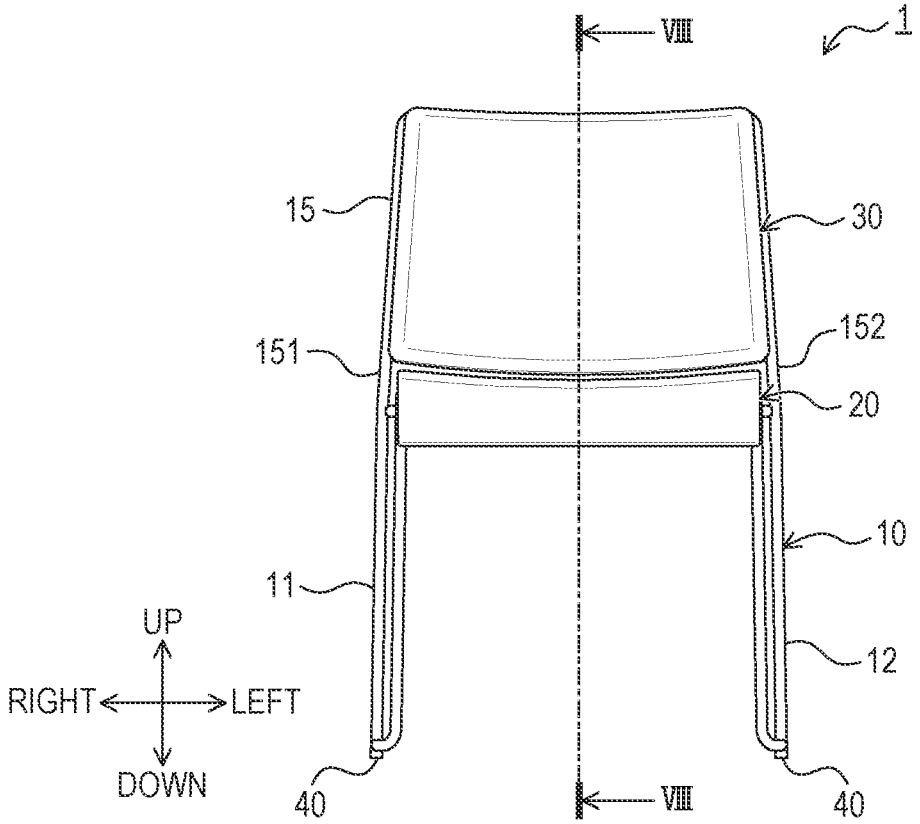
FIG. 3 is a front view of the chair.
Figure 4:
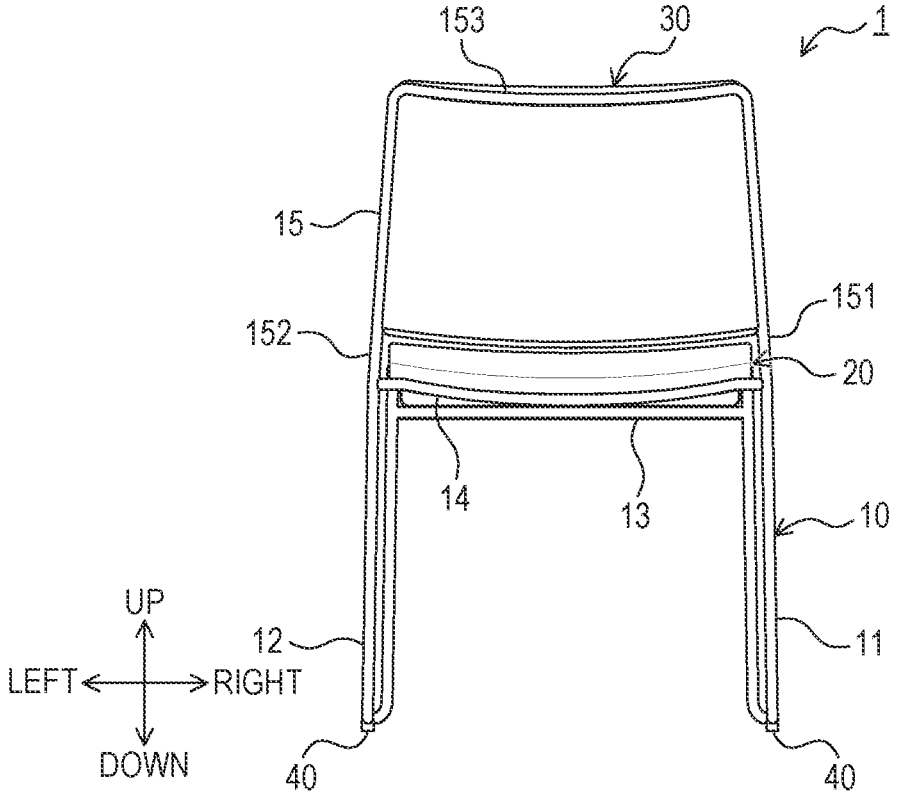
FIG. 4 is a rear view of the chair.
Figure 5:
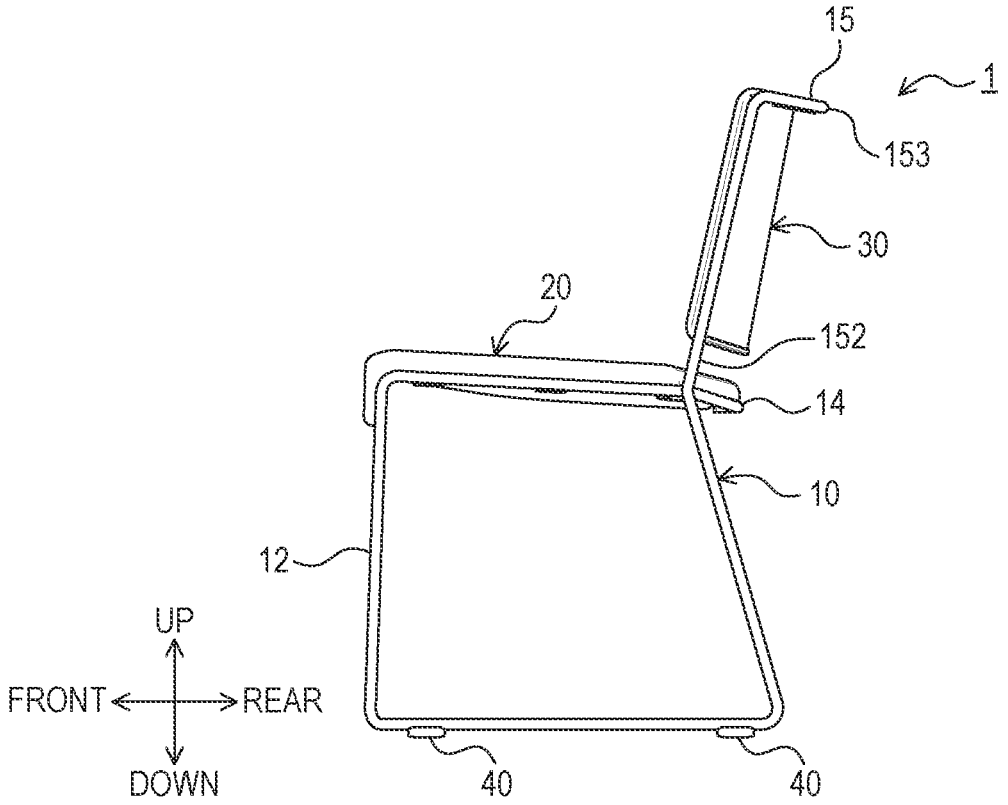
FIG. 5 is a side view of the chair.
Figure 6:
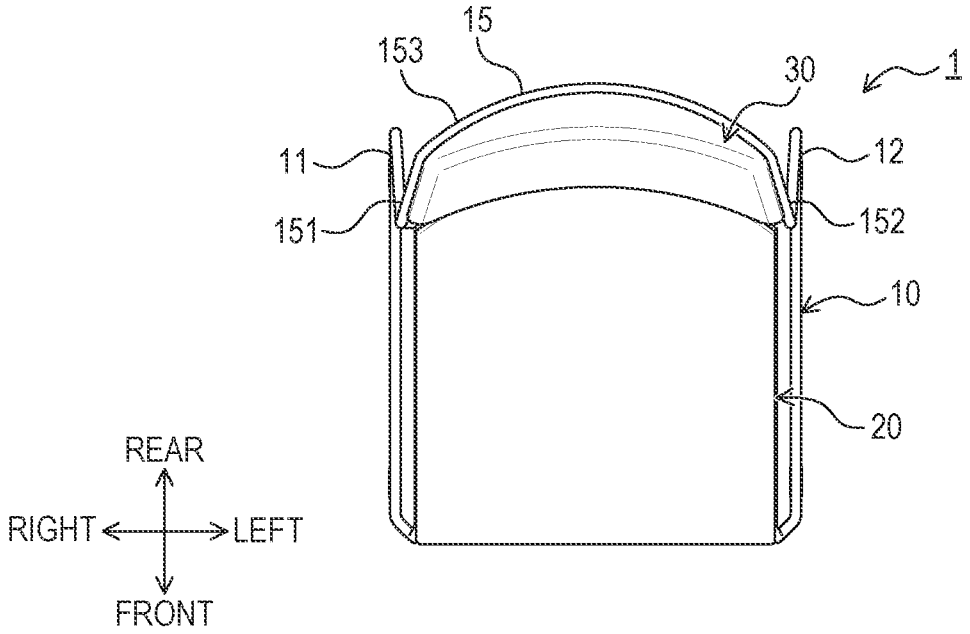
FIG. 6 is a plan view of the chair.

1 . . . chair, 10 . . . support body, 11 . . . right leg, 12 . . . left leg, 13 . . . front connecting portion, 14 . . . rear connecting portion, 15 . . . backrest frame, 20 . . . seat body, 30, 30*a* through 30*d* . . . backrest, 31, 31*a*, 31*b*, 31*e* . . . first plate portion, 32, 32*d*, 32*e* . . . second plate portion, 33, 33*c* . . . attachment portion, 34 . . . urethane cushion, 35 . . . fabric, 40 . . . leg end, 41 . . . engagement portion, 42 . . . fixation portion, 43 . . . engagement hole, 44 . . . through hole, 151, 152 . . . left and right pipes, 153 . . . upper pipe, 311 . . . main body, 312, 312*a*, 312*b*, 312*e* . . . first plate bent portion, 313 . . . extending portion, 321, 321*e* . . . upper end portion, 322 . . . lower end portion, 323 . . . second plate bent portion, 324 . . . rear edge portion, 325 . . . protrusion, 331 . . . projecting portion, 332, 332*a*, 332*c* . . . opening, 333, 333*c* . . . front end face, 334 . . . step portion, 335, 335*a* through 335*d* . . . groove, 336 . . . gap, 337 . . . fitting groove.

MODE FOR CARRYING OUT THE INVENTION

Hereinafter, example embodiments of the present discloser will be described in detail with reference to the drawings.

1. Configuration

[1-1. Chair]

A chair 1 shown in FIG. 1 through FIG. 6 comprises a support body 10, a seat body 20, and a backrest 30. In the following description, up and down directions, front and rear directions, and left and right directions are expressed with respect to a user who is normally seated on the chair 1.

The support body 10 is formed by bending and welding a tubular metal-pipe, and supports the seat body 20 and the backrest 30. The support body 10 comprises a right leg 11, a left leg 12, a front connecting portion 13, a rear connecting portion 14, and a backrest frame 15. The support body may be a bar-shaped member formed of a solid wood material.

The right leg 11 and the left leg 12 are loop-like members each having a substantially rectangular loop shape when viewed in the left and right directions. Each of the right leg 11 and the left leg 12 may be provided with one leg end 40 on a front side and another leg end 40 on a rear side of a lower pipe of each leg disposed along a floor surface on which the chair 1 is placed.

The front connecting portion 13 is a member that extends straight and connects a front pipe of the right leg 11 and a front pipe of the left leg 12.

The rear connecting portion 14 is a member that is curved so as to be convex toward a rear side, and that connects a rear pipe of the right leg 11 and a rear pipe of the left leg 12.

The backrest frame 15 is a member that is connected to connecting parts of the right leg 11 and the left leg 12 where the rear connecting portion 14 is connected to the right leg 11 and the left leg 12, and that is bent into a substantially U shape with an open lower side when viewed in the front and rear directions. The backrest frame 15 comprises a right pipe 151, a left pipe 152, and an upper pipe 153. The upper pipe 153 of the backrest frame 15 is curved so as to be convex toward the rear side, and connects the right pipe 151 and the left pipe 152 of the backrest frame 15 that extend upward from the respective connecting parts where the rear connecting portion 14 is connected to the right leg 11 and the left leg 12. The backrest frame 15 has a substantially L shape such that an upper end portion thereof is bent rearward when viewed in the left and right directions.

Figure 7:
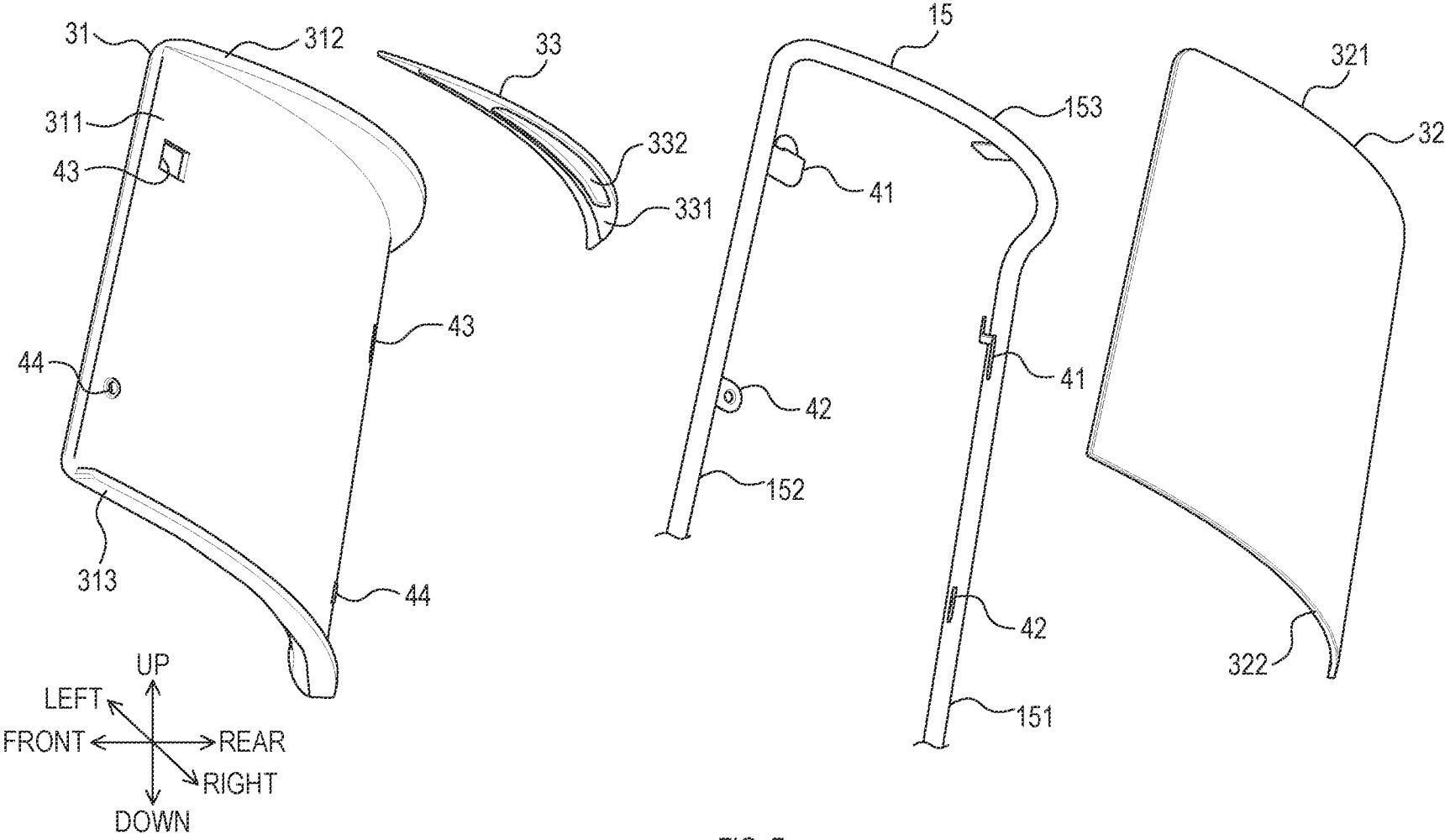
FIG. 7 is an exploded perspective view of a backrest for the chair.

The backrest frame 15 comprises an engagement portion 41 and a fixation portion 42 shown in FIG. 7. One engagement portion 41 and one fixation portion 42 are provided on each of the right pipe 151 and the left pipe 152 of the backrest frame 15. Specifically, the engagement portion 41 and the fixation portion 42 are fixed to the right pipe 151 and the left pipe 152 of the backrest frame 15 through welding or the like so as to be in an inner position situated between the right pipe 151 and the left pipe 152 of the backrest frame 15. The fixation portion 42 is positioned below the engagement portion 41.

Returning to FIG. 1 through FIG. 6, the seat body 20 is configured to allow a user to be seated thereon. The seat body 20 is substantially rectangular in a plan view, and has a shape such that a rear end portion thereof is curved so as to be convex toward the rear side. The seat body 20 has a substantially L shape such that a front end portion thereof is bent downward when viewed in the left and right directions. The seat body 20 is supported by the right leg 11, the left leg 12, the front connecting portion 13, and the rear connecting portion 14. Specifically, end portions of the seat body 20 on both sides in the left and right directions are connected to upper pipes of the right leg 11 and the left leg 12, the front end portion of the seat body 20 is connected to the front connecting portion 13, and the rear end portion of the seat body 20 is connected to the rear connecting portion 14.

The backrest 30 is substantially rectangular in a front view, and is configured to allow a back of the user to be supported. Also, when viewed in a plan view, the backrest 30 is gently curved such that both of end portions on the left and right sides are situated more forward and a central portion thereof is situated more rearward. In other words, the backrest 30 has a curved shape so as to be convex toward the rear side. Also, the backrest 30 has a substantially L shape such that an upper end portion thereof is bent rearward when viewed in the left and right directions. The backrest 30 is supported by the backrest frame 15.

[1-2. Backrest]

Next, a detailed configuration of the backrest 30 will be described, with reference to FIG. 7.

The backrest 30 comprises a first plate portion 31, a second plate portion 32, and an attachment portion 33.

The first plate portion 31 is a front plate to be attached to a front side of the backrest frame 15. The first plate portion 31 is arranged in a position to abut the back of the user of the chair 1. The first plate portion 31 is substantially rectangular in the front view. Also, when viewed in a plan view, the first plate portion 31 is gently curved such that both of end portions on the left and right sides are situated more frontward and a central portion thereof is situated more rearward. In other words, the first plate portion 31 has a curved shape so as to be convex toward the rear side.

The first plate portion 31 comprises a main body 311, a first plate bent portion 312, and an extending portion 313.

The main body 311 is a plate-like portion that is substantially rectangular in the front view and is curved so as to be convex toward the rear side. The main body 311 comprises an engagement hole 43 and a through hole 44.

In the present embodiment, two engagement holes 43 and two through holes 44 are provided on the main body 311 at distances spaced from each other in the left and right directions. The through holes 44 are positioned below the engagement holes 43. The engagement hole 43 is a hole with which the aforementioned engagement portion 41 is engageable. The through hole 44 is a hole into which a fixing tool, for example, a screw, a rivet, and the like is inserted.

The first plate bent portion 312 is a portion bent from an upper end portion of the main body 311 and extending rearward. The first plate bent portion 312 has a substantially crescent shape in the plan view.

The extending portion 313 is a portion bent from a lower end portion of the main body 311 and extending rearward.

The second plate portion 32 is a rear plate to be attached to a rear side of the backrest frame 15. The second plate portion 32 is arranged on a side opposite to the surface of the first plate portion 31 that abuts the back of the user of the chair 1, that is, arranged to face a rear surface of the first plate portion 31. The second plate portion 32 is substantially rectangular in the front view. Also, when viewed in the plan view, the second plate portion 32 is gently curved such that both of end portions on the left and right sides are situated more frontward and a central portion is situated more rearward. In other words, the second plate portion 32 has a curved shape so as to be convex toward the rear side.

The attachment portion 33 has a substantially crescent shape in the plan view. The attachment portion 33 is a separate component attachable to the first plate portion 31. The attachment portion 33 is attached to a lower surface of the first plate bent portion 312 of the first plate portion 31.

Figure 8:
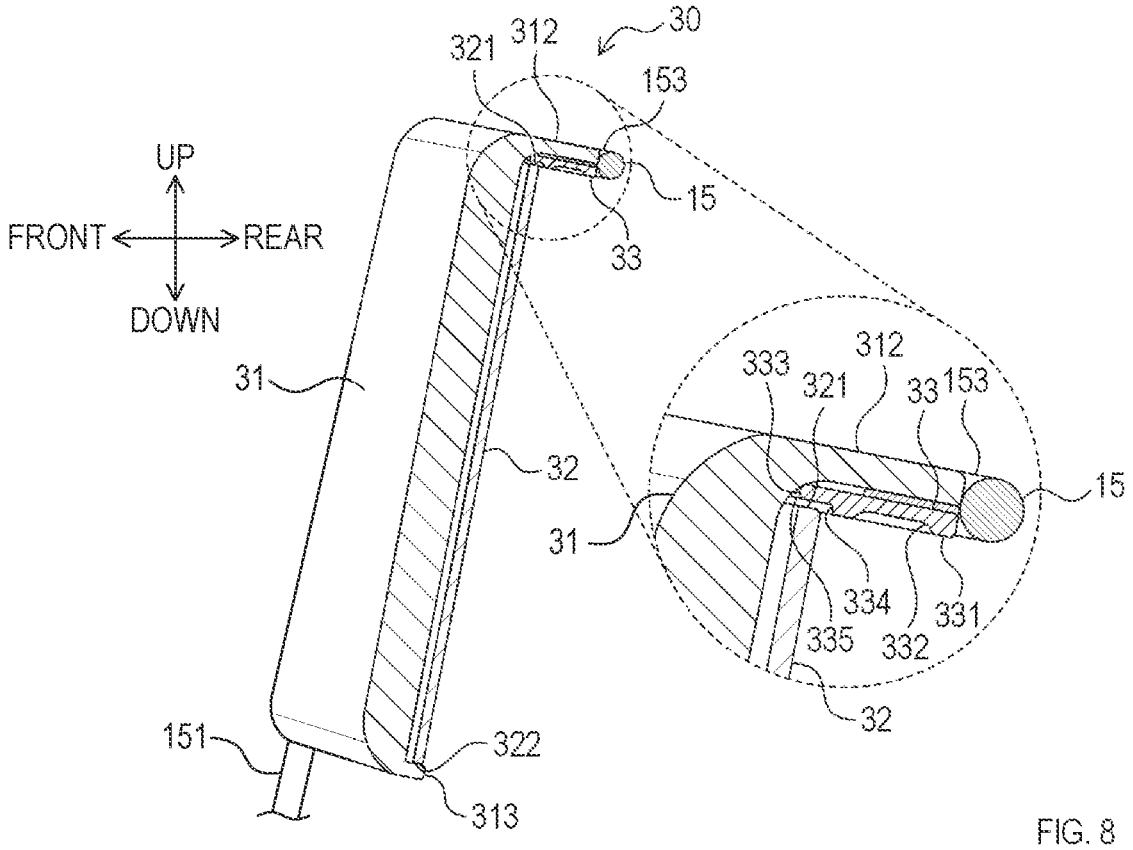
FIG. 8 is a sectional view through line VIII-VIII of FIG. 3 and an enlarged sectional view of a portion around an attachment portion.

As shown in FIG. 7 and FIG. 8, the attachment portion 33 comprises a projecting portion 331 and an opening 332.

The projecting portion 331 is a portion protruding from a lower surface of the attachment portion 33 at a specific distance spaced from a front end face 333 of the attachment portion 33 abutting the first plate portion 31 when the attachment portion 33 is attached to the lower surface of the first plate bent portion 312. The front end face 333 of the attachment portion 33 is a surface curved along a recess direction of the crescent shape. The projecting portion 331 is provided to the attachment portion 33, and thereby a step portion 334 extending in the left and right directions is formed on a front edge portion of the attachment portion 33. The step portion 334 is a portion where the lower surface of the attachment portion 33 and a lower surface of the projecting portion 331 are connected. In other words, the step portion 334 is a front end face of the projecting portion 331. In a case where the attachment portion 33 is attached to the lower surface of the first plate bent portion 312 such that the front end face 333 of the attachment portion 33 abuts the first plate portion 31, a groove 335 recessed toward an upper side by the step portion 334 and extending in the left and right directions is formed between the first plate portion 31 and the projecting portion 331.

The opening 332 is provided to the projecting portion 331 so as to be recessed toward the upper side, and extends in the left and right directions. The opening 332 functions, for example, as a handhold hole that allows a hand to be hooked for carrying the chair 1. That is, in the present embodiment, the attachment portion 33 is a member that exerts a function of facilitating hand-holding that allows a hand to be hooked for carrying the chair 1.

In the present embodiment, the engagement portion 41 provided on the backrest frame 15 is fixed to the engagement hole 43 and, for example, a screw or a rivet is inserted into the through hole 44 and fixed to the fixation portion 42 provided on the backrest frame 15, so that the first plate portion 31 is fixed to the front side of the backrest frame 15. Also, a lower end portion 322 of the second plate portion 32 is brought into contact with the extending portion 313 of the first plate portion 31 in a state where an upper end portion 321 of the second plate portion 32 is fitted into the groove 335 formed through attachment of the attachment portion 33 to the first plate portion 31, so that the second plate portion 32 is fixed to a rear side of the backrest frame 15. At this time, the second plate portion 32 is arranged such that left and right end portions thereof abut inner sides of the right pipe 151 and the left pipe 152 facing each other, of the backrest frame 15.

Figure 9:
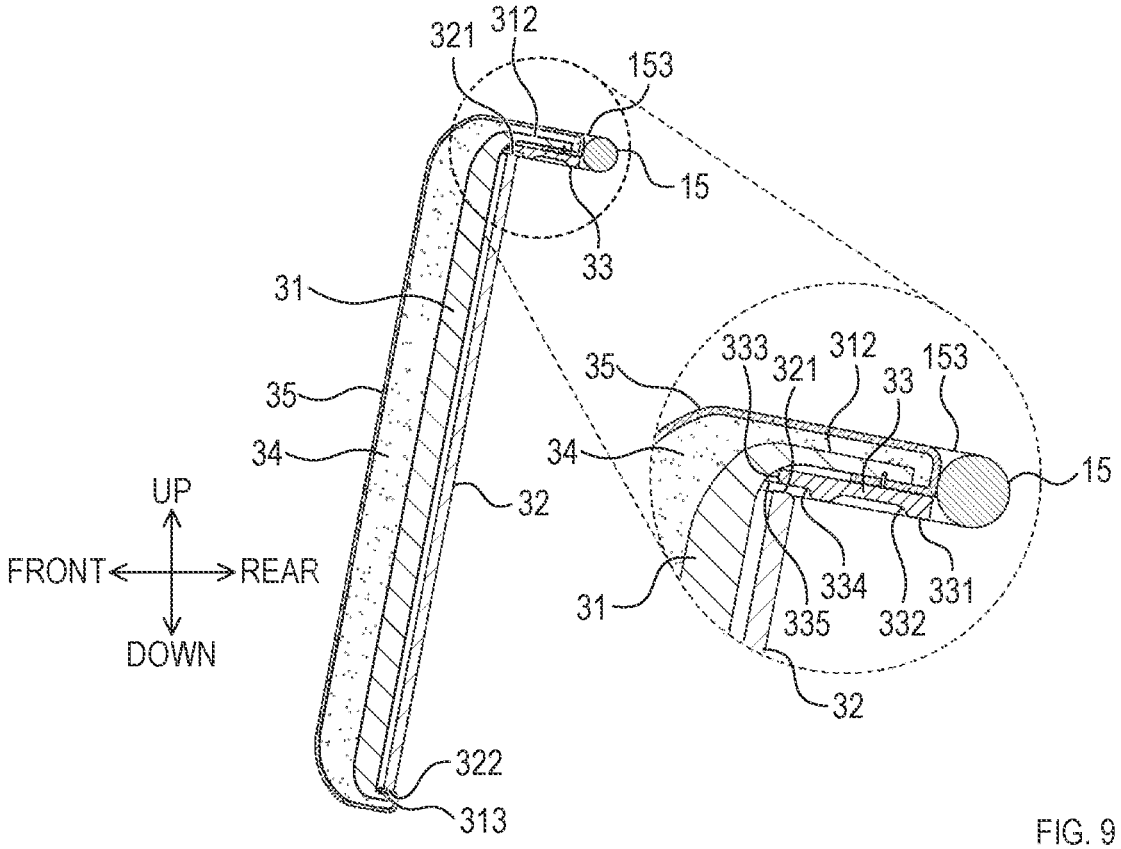
FIG. 9 is a sectional view schematically showing a state where a cushion material is affixed to a first plate portion, and an enlarged sectional view of a portion around a first plate bent portion.

In the aforementioned first plate portion 31, an example configuration is shown in which a cushion material is not affixed thereto is described as an example, but a cushion material may be affixed to a front side of the first plate portion 31. For example, as shown in FIG. 9, the first plate portion 31 may be configured such that a urethane cushion 34 may be affixed to the front side of the first plate portion 31 and the first plate portion 31 may be covered with a fabric 35 or the like over the urethane cushion 34. The fabric 35 wraps an end portion of the first plate bent portion 312 and an end portion of the extending portion 313 so as to cover the end portions thereof, and is fixed to the lower surface of the first plate bent portion 312 and an upper surface of the extending portion 313, for example, by a tacker needle. Further, for example, a cushion pad may be affixed only to the front side of the first plate portion 31. As shown in FIG. 9, in a case where the first plate portion 31 is attached and covered with the urethane cushion 34 and the fabric 35, the attachment portion 33 as a separate component from the first plate portion 31 can cover and hide an end of the fabric 35 drawn to a side where the lower surface of the first plate bent portion 312 is situated, and also a tacker needle for fixing the fabric 35.

2. Effect

According to the embodiment detailed above, the following effects can be obtained.

(2a) In the present embodiment, the upper end portion 321 of the second plate portion 32 is fitted into the groove 335, thereby restricting movement of the second plate portion 32 in at least the front and rear directions and the up direction. Accordingly, it is possible to readily determine a fixation position of the second plate portion 32.

Further, in the present embodiment, the first plate portion 31 is arranged such that the left and right end portions of the second plate portion 32 abut the inner sides of the right pipe 151 and the left pipe 152 facing each other, of the backrest frame 15. Accordingly, movement of the second plate portion 32 in the left and right directions is restricted by the right pipe 151 and the left pipe 152 of the backrest frame 15. Therefore, it is possible to readily determine a fixation position of the second plate portion 32 in the left and right directions.

Further, in the present embodiment, the lower end portion 322 of the second plate portion 32 is brought into contact with the extending portion 313 of the first plate portion 31 in the state where the upper end portion 321 of the second plate portion 32 is fitted into the groove 335. Accordingly, movement of the second plate portion 32 in the down direction is restricted. Accordingly, it is possible to readily determine a fixation position of the second plate portion 32 in the up and down directions. Therefore, it is possible to readily fix the second plate portion 32, which forms the backrest 30, to the chair 1, and also removal is easy.

(2b) In the present embodiment, the groove 335 has a length extending in the left and right directions, thereby inhibiting the second plate portion 32 fitted into the groove 335 from shifting especially in the front and rear directions. Accordingly, an easy work of fitting the upper end portion 321 of the second plate portion 32 into the groove 335 enables a stable restriction of movement of the second plate portion 32 in at least the front and rear directions and the up direction.

(2c) In the present embodiment, the groove 335 is formed through attachment of the attachment portion 33, which is a separate component from the first plate portion 31, to the first plate portion 31. Accordingly, for example, it is possible to increase a degree of freedom in shape of the first plate portion 31, compared to a configuration in which the groove 335 is formed directly on the first plate portion 31 so as to be integral with the first plate portion 31.

(2d) In the present embodiment, a member that exerts a function of making it easy to allow a hand to be hooked for carrying the chair 1 is used as the attachment portion 33. Thus, it is possible to readily form the groove 335 while adding another function to the chair.

(2e) In the present embodiment, the upper pipe 153 protrudes to the rear side, so that it is possible to hold the upper pipe 153 for carrying the chair 1. This allows the upper pipe 153 to function as a handhold for carrying the chair 1.

(2f) In the present embodiment, the first plate bent portion 312 is shaped to extend rearward, so that it is possible to hold the first plate bent portion 312 for carrying the chair 1. That is, the first plate bent portion 312 of the backrest 30 can function as a handhold for carrying the chair 1. Further, longer a length of the first plate bent portion 312 is, larger an area of a portion functioning as a handhold is. This makes it easy to hold the first plate bent portion 312, and as the result it becomes easy to carry the chair 1.

(2g) In the present embodiment, it is possible to hold at least one of the first plate bent portion 312 or the upper pipe 153 to carry the chair. That is, it is possible for any of the first plate bent portion 312 and the upper pipe 153 to function as a handhold. Accordingly, the area of a portion functioning as a handhold becomes larger, thus making it easy to hold the first plate bent portion 312 or the upper pipe 153. As the result, it becomes easy to carry the chair 1.

(2h) In the present embodiment, it is possible to put a hand in a gap 336 between the first plate bent portion 312 and the upper pipe 153 so as to carry the chair 1. That is, the gap 336 can function as a handhold hole.

In the present embodiment, the right pipe 151 corresponds to one example of a right bar-shaped member, the left pipe 152 corresponds to one example of a left bar-shaped member, the upper pipe 153 corresponds to one example of an upper bar-shaped member, and the first plate bent portion 312 corresponds to one example of a bent portion.

3. Other Embodiments

Although an embodiment of the present disclosure is described above, it is to be understood that the present disclosure is not limited to the above-described embodiment, but may be in various forms.

(3a) In the aforementioned embodiment, an example configuration is shown in which the groove 335 is formed by the step portion 334 formed on the attachment portion 33 that is a separate component from the first plate portion 31. However, a forming method of a groove is not limited to such configuration.

Figure 10:
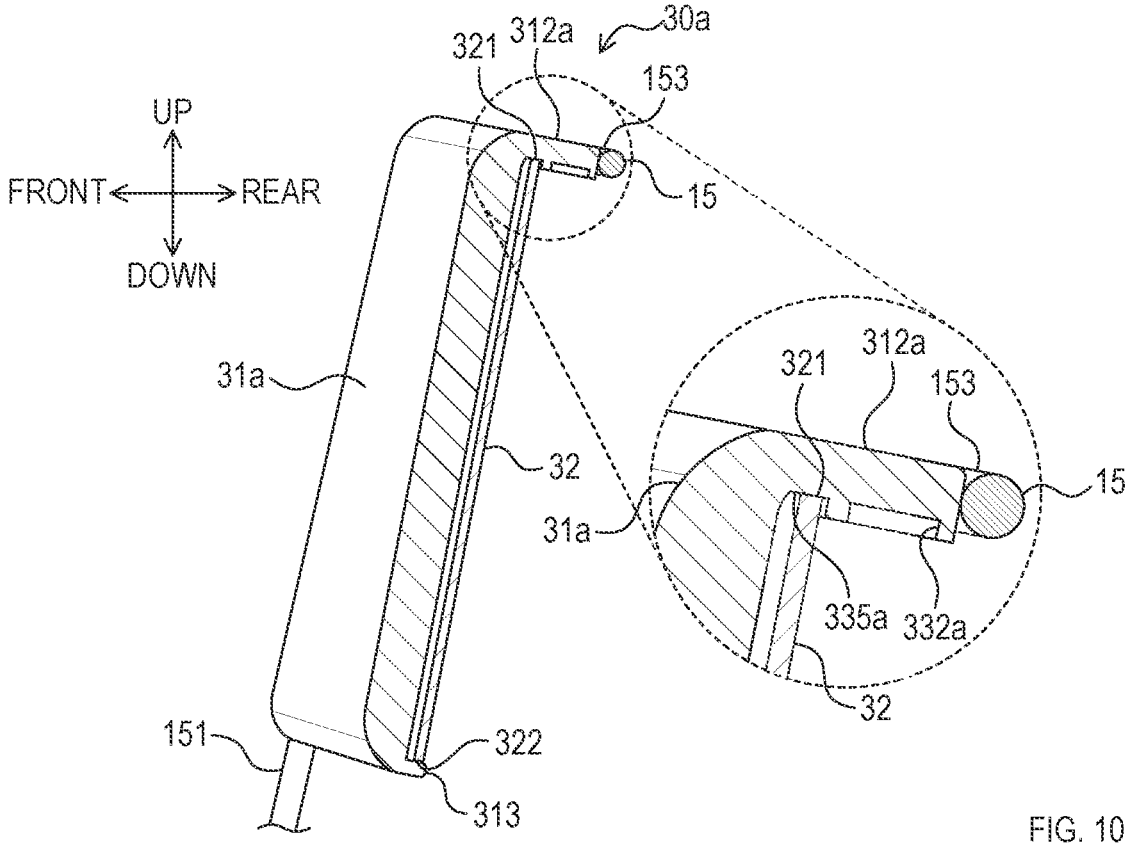
FIG. 10 is a sectional view showing a variation of the backrest comprising a groove integral to a first plate portion, and an enlarged sectional view of a portion around the first plate bent portion.
Figure 11:
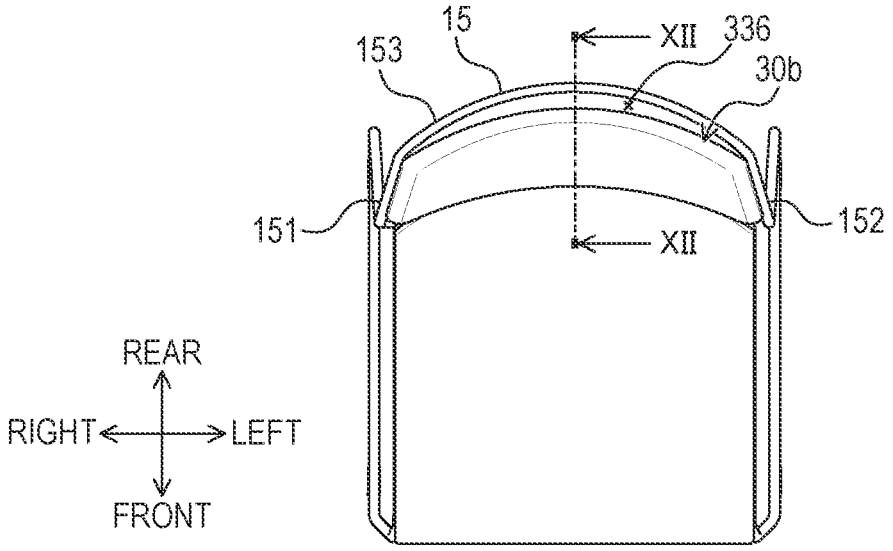
FIG. 11 is a plan view showing a configuration in which a gap is formed between the first bent portion and an upper pipe.
Figure 12:
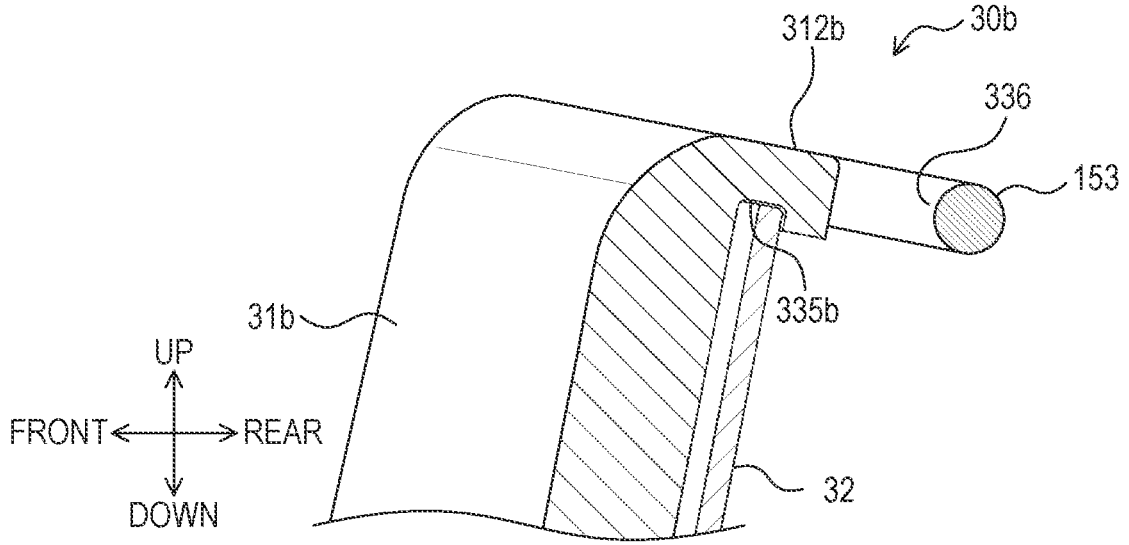
FIG. 12 is a sectional view through line XII-XII of FIG. 11.

For example, a groove 335*a* may be formed integrally with a first plate portion 31*a*, as in a backrest 30*a* shown in FIG. 10. That is, the groove 335*a* may be formed directly on a first plate bent portion 312*a* of the first plate portion 31*a*. An opening 332*a* may be also formed directly on the first plate bent portion 312*a* of the first plate portion 31*a* such that the opening 332*a* is recessed toward the upper side, extends in the left and right directions, and functions as a handhold hole. In a configuration in which a groove 335*b* is formed on a first plate bent portion 312*b* of a first plate portion 31*b*, as in a backrest 30*b* shown in FIG. 11 and FIG. 12, the first plate portion 31*b* may be supported by the backrest frame 15 so as to have the gap 336 between the first plate bent portion 312*b* and the upper pipe 153. In such a configuration, the gap 336 functions as a handhold hole.

Figure 13:
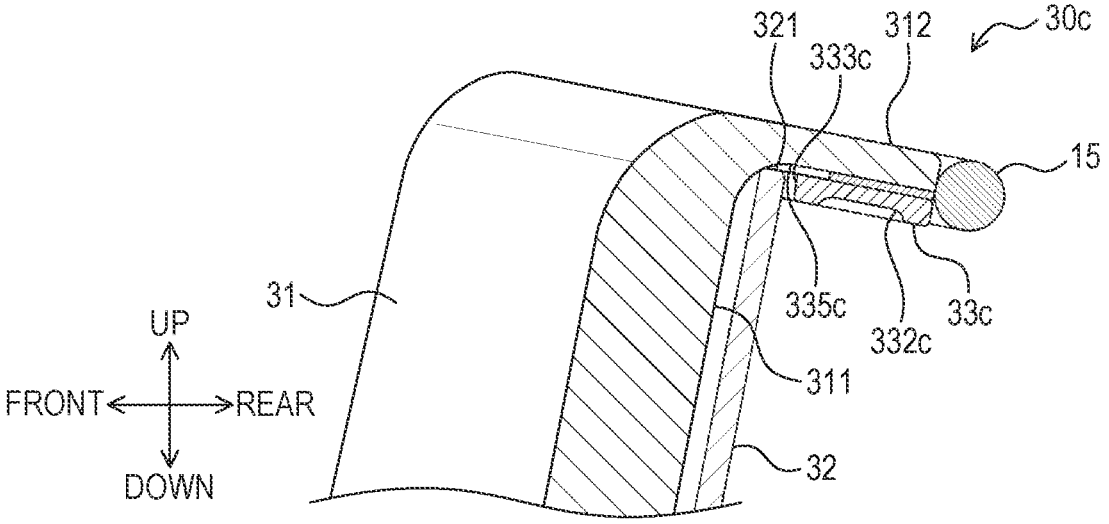
FIG. 13 is an enlarged sectional view of a portion around a first plate bent portion to which an attachment portion having a different shape is attached.

Further, for example, an attachment portion 33*c* having a specific thickness in the up and down directions may be included, as in a backrest 30*c* shown in FIG. 13. The attachment portion 33*c* comprises an opening 332*c*. The opening 332*c* is provided so as to be recessed toward the upper side in the vicinity of a center portion thereof, and extend in the left and right directions. A groove 335*c* may be formed through attachment of the attachment portion 33*c* to the lower surface of the first plate bent portion 312 of the first plate portion 31 at a distance spaced from the main body 311 such that a front end face 333*c* of the attachment portion 33*c* does not abut the first plate portion 31. The upper end portion 321 of the second plate portion 32 is fitted into the groove 335*c* formed between the attachment portion 33*c* and the main body 311. In this example, the upper end portion 321 of the second plate portion 32 is fitted into the groove 335*c*, thereby restricting the second plate portion 32 from moving in the front and rear directions and the up direction. In other words, movement of the second plate portion 32 in the front direction is restricted by the main body 311, movement of the second plate portion 32 in the up direction is restricted by the first plate bent portion 312, and movement of the second plate portion 32 in the rear direction is restricted by the attachment portion 33*c*.

Figure 14:
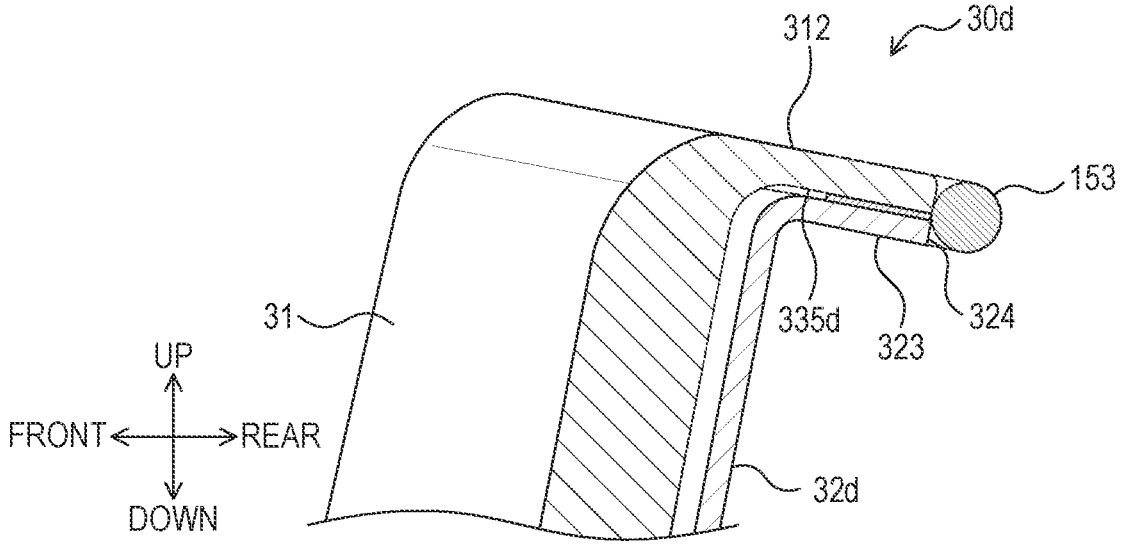
FIG. 14 is an enlarged sectional view of a portion around a first plate bent portion of a backrest comprising a second plate portion including a second plate bent portion.

Further, for example, as in a backrest 30*d* as shown in FIG. 14, a second plate portion 32*d* may comprise a second plate bent portion 323 on its upper end portion side. The second plate bent portion 323 is a portion bent and extends rearward. The second plate bent portion 323 is attached to the lower surface of the first plate bent portion 312 such that the second plate bent portion 323 is arranged so as to face the first plate bent portion 312, and a rear edge portion 324 of the second plate bent portion 323 abuts the upper pipe 153. That is, in this example, the first plate bent portion 312 is supported by the upper pipe 153 such that a portion of the upper pipe 153 protrudes downward relative to the lower surface of the first plate bent portion 312, thereby forming a groove 335*d* that allows the second plate bent portion 323 to be fitted thereinto. As described, the second plate bent portion 323 is fitted into the groove 335*d*, thereby restricting the second plate portion 32*d* from moving in the front and rear directions and the up direction. In other words, movement of the second plate portion 32*d* in the front direction is restricted by the main body 311, movement of the second plate portion 32*d* in the up direction is restricted by the first plate bent portion 312, and movement of the second plate portion 32*d* in the rear direction is restricted by the upper pipe 153. In this example, an example configuration is shown in which the second plate bent portion 323 in the upper end portion of the second plate portion 32 extends in the front and rear directions. However, in a configuration in which a second plate portion does not comprise a second plate bent portion, the upper end portion of the second plate portion may be configured to be fitted into a groove formed between the first plate portion 31 and an upper pipe supporting the first plate portion 31. Even in such configuration, the upper end portion of the second plate portion abuts the upper pipe, thereby being restricted from moving in the rear direction, and abuts the first plate portion 31, thereby being restricted from moving in the front direction and the up direction.

Figure 15:
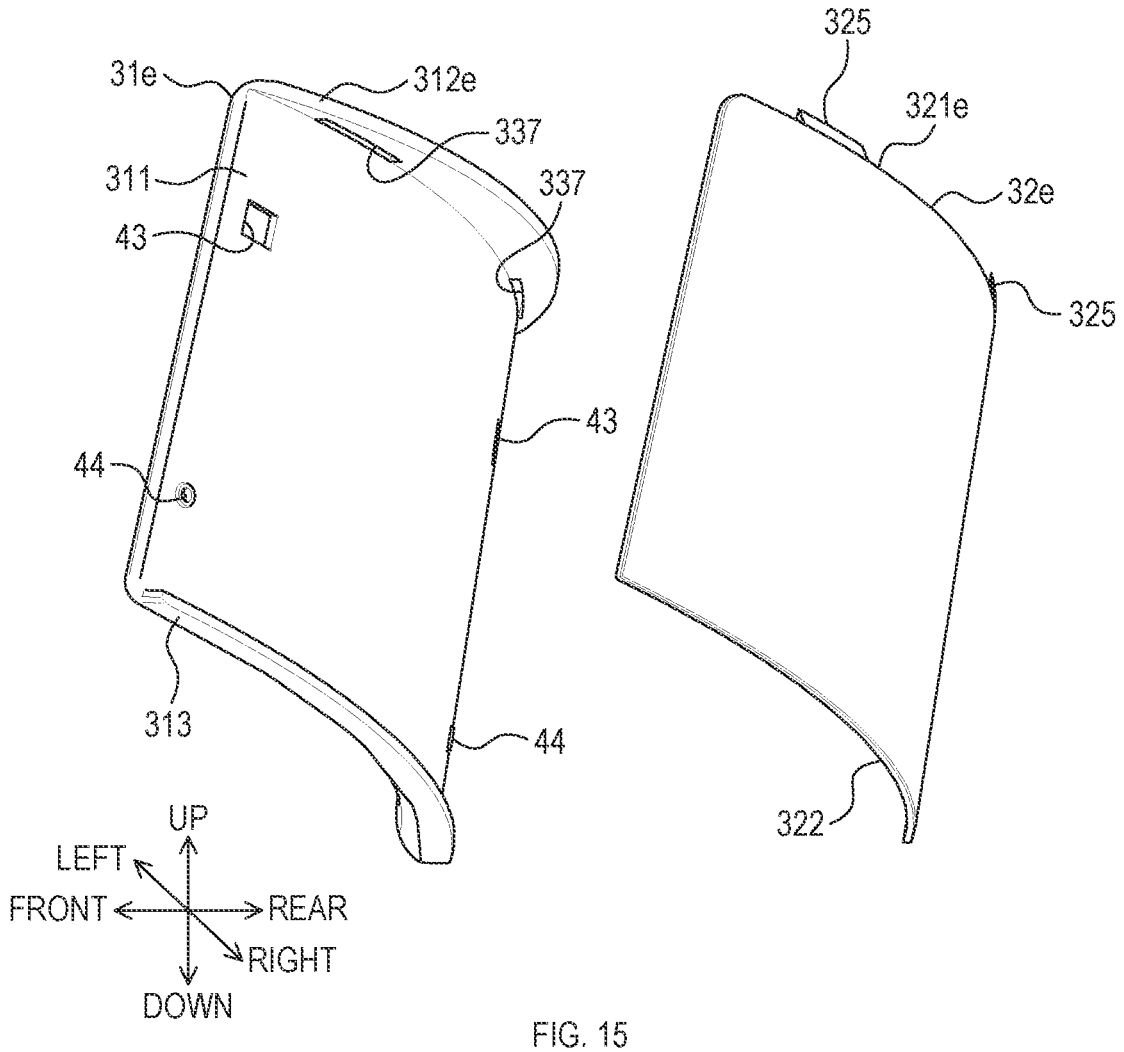
FIG. 15 is a diagram of a configuration in which the first plate portion comprises a fitting hole recessed toward an upper side on a lower surface of the first bent portion, and in which the second plate portion comprises a protrusion on an upper end portion thereof.

(3b) A shape that allows the upper end portion 321 of the first plate portion 31 to be fitted is not limited to the groove 335. For example, a groove may shorter in the left and right directions than the groove 335. Two or more grooves may be provided at a distance spaced from each other. Specifically, the present disclosure may include a configuration in which, as shown in FIG. 15, two protrusions 325 are formed on an upper end portion 321*e* of a second plate portion 32*e*, and two fitting grooves 337 are formed on a first plate bent portion 312*e* of a first plate portion 31*e* so as to allow the two protrusions 325 to be fitted thereinto. The number of a protrusion and the number of a fitting groove are each not limited to two, and may be one, or three or more. Further, a shape that allows the upper end portion 321 of the first plate portion 31 to be fitted may be a shape other than a groove. For F example, two or more protrusions may be provided on a first plate bent portion so as to be aligned in the left and right directions, thereby forming a space for fitting the upper end portion 321 therebetween. Further, for example, two or more claws may be provided on the first plate bent portion, thereby allowing the upper end portion 321 to be interposed therebetween.

(3c) In the aforementioned embodiment, an example configuration is shown in which the second plate portion 32 is arranged such that left and right end portions thereof abut inner sides of the left and right pipes 151, 152 facing each other, of the backrest frame 15. However, the configuration in which the second plate portion 32 is restricted from moving in the left and right directions is not limited to such configuration. For example, a side restricting portion capable of restricting movement of the second plate portion 32 in the left and right directions may be provided to the first plate portion 31 or the backrest frame 15. Further, a backrest need not to have a configuration in which, for example, movement of the second plate portion 32 in the left and right directions is restricted.

(3d) In the aforementioned embodiment, an example configuration is shown in which the lower end portion 322 of the second plate portion 32 abuts the extending portion 313 of the first plate portion 31. However, the configuration in which the second plate portion 32 is restricted from moving downward is not limited to such configuration. For example, the second plate portion may comprise an abutting portion that protrudes frontward and abuts the extending portion 313. Further, a backrest need not to have a configuration in which, for example, downward movement is restricted.

(3e) The first plate portion 31 and the second plate portion 32 may further comprise a fixing mechanism. For example, the first plate portion 31 and the second plate portion 32 may be fixable using a rivet, a screw, an adhesive or a hook-and-loop fastener, or the like.

(3f) A function performed by a single element in the aforementioned embodiments may be achieved by a plurality of elements, or a function performed by a plurality of elements may be achieved by a single element. Also, a portion of a configuration in the aforementioned embodiments may be omitted. Moreover, at least a portion of a configuration in the aforementioned embodiments may be added to, or may replace, another configuration in the aforementioned embodiments. Any form included in the technical idea defined only by the language of the claims may be an embodiment of the present disclosure.

The invention claimed is:

1. A chair comprising:

a backrest configured to support a back of a user of the chair; and a backrest frame supporting the backrest;

wherein the backrest includes a main body in plate form and a bent portion, the main body abutting the back of the user, the bent portion being bent from an upper end portion of the main body and extending rearward, wherein the backrest frame comprises a right bar-shaped member supporting a right side of the backrest, a left bar-shaped member supporting a left side of the backrest, and an upper bar-shaped member supporting an upper side of the backrest, wherein the backrest is supported by the backrest frame such that a surface facing rearward in a rear edge portion of the bent portion and the upper bar-shaped member abut each other fully in a width direction of the backrest, wherein the bent portion has a plate shape such that upper and lower surfaces thereof are substantially parallel rearward, and the bent portion has a thickness substantially the same as a thickness of the upper bar-shaped member abutting the rear edge portion of the bent portion, and wherein the upper bar-shaped member protrudes so as to be convex toward a rear side, and connects the right bar-shaped member and the left bar-shaped member.

2. The chair according to claim 1, further comprising a seat body configured to allow the user to be seated thereon, wherein the right bar-shaped member and the left bar shaped-member each extend in the upper and lower directions to be straight from a top of either the right bar-shaped member or the left bar shaped-member to the seat body.

3. The chair according to claim 1, wherein the bent portion includes an opening provided on a lower surface of the bent portion, recessed upward, and elongated in left and right directions.

4. The chair according to claim 1, further comprising an attachment portion that is a separate element attachable to a lower surface of the bent portion, wherein the attachment portion includes an opening formed therein, recessed upward, and elongated in left and right directions.

5. The chair according to claim 4, wherein the bent portion and the attachment portion each have a substantially crescent shape when viewed from above.

* * * * *